US006363691B1

(12) United States Patent
Flaherty

(10) Patent No.: US 6,363,691 B1
(45) Date of Patent: Apr. 2, 2002

(54) METHOD OF WRAPPING A PACKAGE HAVING A CORONA TREATED TEAR TAPE

(75) Inventor: Kenneth A. Flaherty, Louisville, KY (US)

(73) Assignee: Brown & Williamson Tobacco Corporation, Louisville, KY (US)

( * ) Notice: Subject to any disclaimer, the term of this patent is extended or adjusted under 35 U.S.C. 154(b) by 0 days.

(21) Appl. No.: 09/404,128

(22) Filed: Sep. 23, 1999

(51) Int. Cl.[7] ..... B65B 61/18
(52) U.S. Cl. ..... 53/412; 229/87.05
(58) Field of Search ..... 229/87.05, 239; 206/264; 53/412, 397, 399, 401, 402, 419, 460, 133.5, 133.7, 137.2

(56) References Cited

U.S. PATENT DOCUMENTS

| | | | | | |
|---|---|---|---|---|---|
| 3,379,364 | A | * | 4/1968 | Pilger | 229/87.05 |
| 3,489,637 | A | * | 1/1970 | Gresl et al. | 156/521 |
| 4,120,716 | A | | 10/1978 | Bonet | |
| 4,253,896 | A | | 3/1981 | Appleyard et al. | |
| 4,844,962 | A | | 7/1989 | May et al. | |
| 4,887,408 | A | * | 12/1989 | Mattei et al. | 53/412 |
| 4,908,094 | A | | 3/1990 | Jones et al. | |
| 5,203,935 | A | | 4/1993 | May et al. | |
| 5,249,676 | A | | 10/1993 | Ashcraft et al. | |
| 5,421,932 | A | | 6/1995 | Fujio | |
| 5,510,165 | A | * | 4/1996 | Seki | 426/67 |
| 5,595,803 | A | * | 1/1997 | May et al. | 428/43 |
| 5,799,793 | A | * | 9/1998 | Glod, Sr. et al. | 206/554 |
| 5,962,099 | A | * | 10/1999 | Bloch et al. | 428/41.4 |
| 6,020,412 | A | * | 2/2000 | Muschelewicz et al. | 524/296 |
| 6,027,770 | A | * | 2/2000 | Yoshino | 427/444 |
| 6,073,767 | A | * | 6/2000 | Cohen et al. | 206/363 |
| 6,105,780 | A | * | 8/2000 | Nguyen | 206/554 |
| 6,113,271 | A | * | 9/2000 | Scott et al. | 383/211 |
| 6,124,018 | A | * | 9/2000 | Yoshino | 428/122 |
| 6,138,437 | A | * | 10/2000 | Focke et al. | 53/133.7 |

FOREIGN PATENT DOCUMENTS

| | | | | |
|---|---|---|---|---|
| JP | 6254481 | * | 9/1994 | 427/516 |

OTHER PUBLICATIONS

The Wiley Encyclopedia of Packaging Technology.

* cited by examiner

*Primary Examiner*—Rinaldi I. Rada
*Assistant Examiner*—John Paradiso
(74) *Attorney, Agent, or Firm*—Charles G. Lamb; Joan L. Simunic; Middleton Reutlinger

(57) ABSTRACT

A package is provided with a plastic overwrap having a tear tape treated with a corona discharge. The tear tape has a tear tab which overlaps a portion of the tear tape on the wrapped package. The corona treatment of the tear tape allows the tear tab to adhere to the tear tape at said overlap.

13 Claims, 1 Drawing Sheet

METHOD OF WRAPPING A PACKAGE HAVING A CORONA TREATED TEAR TAPE

BACKGROUND OF THE INVENTION

This invention relates to a wrapped package having a corona treated tear tape and more particularly, to a plastic film wrapped package having a corona treated tear tape with an overlapping bonding tear tab.

In the manufacturing of packages of cigarettes as well as other consumer products, it is common to wrap the package in a plastic film with a tear tape circumscribing the film. The tear tape is generally positioned near the top of the package and has a loose end or tab of tear tape that the consumer can pull to split the plastic overwrap into a top section and a bottom section. The user can then easily remove the top portion of the torn away overwrap thereby providing easy access into the package. However, in the packaging of a number of products, the tear tape is generally silicone treated on one side and coated with a pressure sensitive adhesive on the other side of the tape. The loose tab is then adhered, or glued, to the tear tape at the overlapping position. This can create problems for the user because it can be difficult to grab the tear tab. In order to provide a tab that does not adhere to the tear tape at the overlapping positions, which are typically along the seams of the plastic overwrap, an unsealed gap is generally left at the seam. This unsealed gap allows for moisture loss or gain, of for the possibility of infestation of the pack contents.

SUMMARY OF THE INVENTION

It is an object of the present invention to provide a wrapped package having a corona treated tear tape which improves adhesion of an adhesive coated side of the tear tape to a silicone coated side of the tape at overlapped portions.

It is a further object of the present invention to provide a method of wrapping a package having a tear tape thereon which reduces the opportunities for a gap at the overlapping portions of the tear tape thereby eliminating or reducing the possibility of moisture loss or gain or infestation into the contents of the package.

It is also an object of the present invention to provide a method of wrapping a package using a corona treated tear tape.

More particularly, the present invention relates to a method of wrapping a package comprising the steps of: a) treating a tear tape having an adhesive on one side and a non-bonding treatment on an opposite side to a corona discharge on the non-bonding treatment side of the tape; b) attaching the corona discharge treated tear tape to a selected area of a plastic transparent material to make an overwrap material; and, c) wrapping a package with the overwrap material, such that a tear tab formed as a projecting end of the tear tape overlaps and adheres to the tear tape.

BRIEF DESCRIPTION OF THE DRAWINGS

A better understanding of the invention will be had upon reference to the following description in conjunction with the accompanying drawings in which like numerals refer to like parts throughout the several views and wherein.

DETAILED DESCRIPTION OF THE PREFERRED EMBODIMENT

Figure 1:
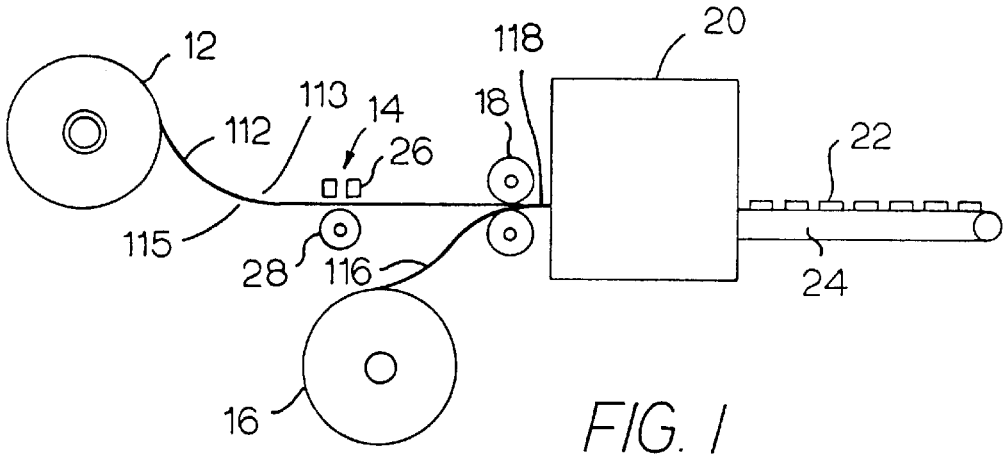
FIG. 1 is a schematic view of a process of wrapping a package in accordance with the present invention.

With reference to FIG. 1, there is shown a roll of tear tape 112 on a reel 12. The tear tape 112 is a plastic film having a non-bonding treatment, such as a silicone release agent, on a topside 113 and having an adhesive on an underside 115. Tear tape 112 on the reel 12 is continually fed to a corona discharge treating apparatus 14 where the topside 113 is subjected to a corona treatment by a plurality of electrodes 26. The electrodes 26 are spaced above a treater roll 28 thereby providing an air gap between the electrodes 26 and the topside 113 of the film 112 as the film 112 passes through the treating apparatus 14. The electrodes 26 are in electrical communication with a corona generator (not shown) and the treater roll 28 is grounded. Generally, the generator provides a relatively high voltage to the electrodes 26. The subjection of the topside 113 of the tear tape film to the corona discharge treatment has been found to alter the chemical make-up of the surface of the plastic tear tape 112 so that the corona treated discharge surface will have improved bonding or adherence to the underside 115 of the film.

After the topside surface 113 of the tear tape 112 has been subjected to the corona discharge treating apparatus 14, the tear tape 112 is then continually fed into a machine 18, such as a 4350 or C-600 type machine supplied by GD, which includes a pair of rollers 18 therein to receive the tear tape 112 and a plastic wrapping material 116 from a reel 16 of a plastic material. In the machine 18 for adhering the tear tape 112 to the plastic wrapping material 116, the tear tape 112 is brought to a temperature sufficient to secure the tear tape 112 to the wrapping material 116. The resulting overwrap material 118 has the tear tape 112 adhered to the wrapping material 116 at a preselected position therealong. The overwrap 118 is fed into a package wrapping machine, such as a cigarette wrapping machine 20 like a type 750 manufactured by Focke & Company. The wrapping machine 20 receives unwrapped packages of cigarettes from a cigarette making machine (not shown), and wraps the packages with the overwrap 118. The transparent overwrap 118 is wrapped around the cigarette package forming a longitudinal seam 32, is heat sealed along the longitudinal seam 32, then is folded over the package at the top and bottom and heat sealed. Overwrapped packages of cigarettes 22 or the like from the wrapping machine, are then deposited onto an endless conveyor 24 for further handling and packaging into cartons, boxes and the like.

Figure 2:
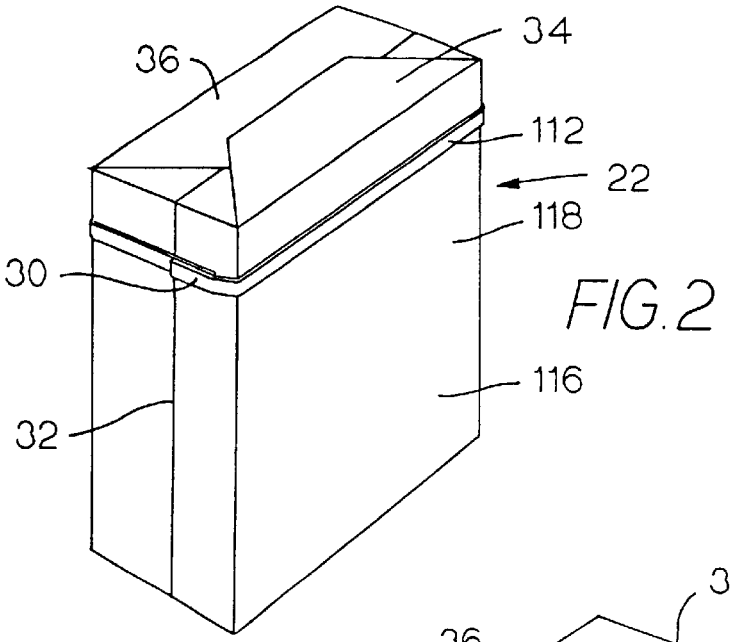
FIG. 2 is a perspective view of a wrapped package in accordance with the method of the present invention; and, FIG. 3 is a perspective view of FIG. 2 showing a partial tear away of tear tape.
Figure 3:
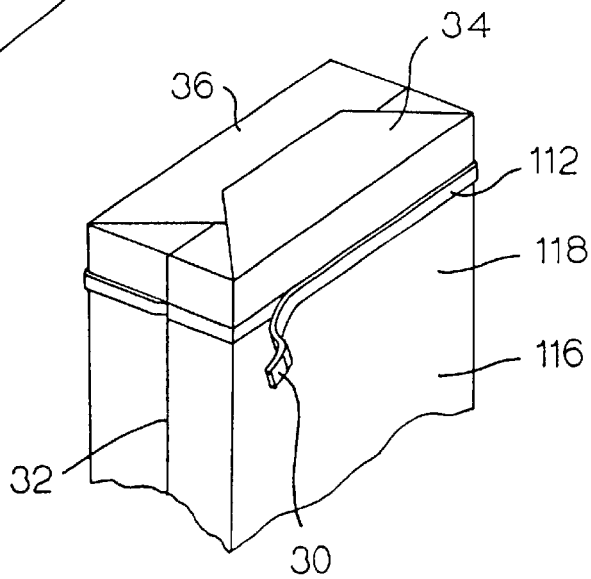

In an embodiment, shown in FIGS. 2 and 3, the package 22 is wrapped in the overwrap 118 such that the top and bottom of the package 22 can be sealed with multi-fold trapezoidal-shaped flaps 34 and 36 and the tear tape 112 circumscribes the upper portion of the package 22. The tear tape 112 terminates with a tear tab 30, which is a projecting end of the tear tape 112. When the overwrap 118 wraps the package 22, the tear tape 30 overlaps a portion of the tear tape 112 allowing the adhesive coated underside 115 to adhere to the corona-treated topside 113. Generally, the overlap of the tear tape 112 is along the seam 32 of the overwrap 118 which wraps the cigarette package. As shown in FIG. 3, when the tab 30 is pulled, the tear tape 112, which is adhesively secured to the overwrap 118, separates the upper portion of the overwrap (a "tear-away" portion) from the bottom portion (a "remaining" portion) thereby allowing the top portion of the overwrap to be removed sop that the consumer has easy access to the contents of the package.

The foregoing description is given primarily for clearness of understanding and no unnecessary limitations are to be understood therefrom for modifications will become obvious to those skilled in the art upon reading this disclosure and may be made without departing from the spirit of the invention and the scope of the appended claims.

What is claimed is:

1. A method of wrapping a package comprising the steps of:

a) treating a first side of a tear tape with a corona discharge, said tear tape having a non-bonding treatment on said first side and an adhesive on a second side;

b) adhering said second side of said corona-treated tear tape to a plastic film material to form an overwrap material;

c) wrapping a package, having a top, a bottom and at least one side, with said overwrap material such that said overwrap forms a longitudinal seam and a portion of said tear tape extends beyond said longitudinal seam to form a tear tab; and d) heat-sealing said overwrap about said package so as to form a top seal, a bottom seal and a longitudinal side seal, said tear tab overlapping and adhering to a portion of said tear tape.

2. The method of claim 1, said tear tape being in reel form.

3. The method of claim 1, said film material being in reel form.

4. The method of claim 1, said package being a cigarette package.

5. The method of claim 1, said non-bonding treatment being a silicone release agent.

6. The method of claim 1, wherein said first side is treated with a corona discharge by passing said tear tape between electrodes in electrical communication with a corona generator, and a grounded corona treater roll such that said first side faces said electrodes and said second side faces said treater roll.

7. The method of claim 6, wherein an air gap remains between said first side and said electrodes.

8. The method of claim 1, wherein said film material is a transparent plastic material.

9. The method of claim 1, wherein said corona-treated tear tape is adhered to said film material by heating said tear tape.

10. The method of claim 1, wherein said package is wrapped by placing a package on a continuous length of said overwrap such that said overwrap extends beyond the top and the bottom of said package, cutting said overwrap such that the longitudinal seam can be made along the side of said package by overlapping layers of said film material and such that said tear tab can extend beyond the said longitudinal seam.

11. A wrapped package comprising:

a package; and, an overwrap, said overwrap comprising a plastic film material and a corona-treated tear tape, said tear-tape having a first side with a non-bonding treatment and a second side with an adhesive, said tear tape being adhered to said film material such that said second side adjoins said film material, said overwrap circumscribing said package and having a multi-fold top seal, a multi-fold bottom seal and a longitudinal seam, and said overwrap having a tear tab which is an extension of said tear tape, said tear tab overlapping and adhering to a portion of said tear tape at said longitudinal seam.

12. The package of claim 11 wherein said package is a cigarette package.

13. The package of claim 11 wherein said non-bonding treatment is a silicone release agent.

* * * * *